US008919352B2

(12) United States Patent
Cocks et al.

(10) Patent No.: US 8,919,352 B2
(45) Date of Patent: Dec. 30, 2014

(54) HAIR IRON

(75) Inventors: Janet Elizabeth Cocks, Mindarie (AU); Edward Joseph Khoury, Bateman (AU); Anne Lynette Vine, Kallaroo (AU)

(73) Assignee: Wisetype Investments Pty Ltd, Mindarie, Western Australia (AU)

( * ) Notice: Subject to any disclaimer, the term of this patent is extended or adjusted under 35 U.S.C. 154(b) by 0 days.

(21) Appl. No.: 14/127,125

(22) PCT Filed: Jun. 15, 2012

(86) PCT No.: PCT/AU2012/000686

§ 371 (c)(1),
(2), (4) Date: Dec. 17, 2013

(87) PCT Pub. No.: WO2012/171066

PCT Pub. Date: Dec. 20, 2010

(65) Prior Publication Data

US 2014/0137887 A1 May 22, 2014

(30) Foreign Application Priority Data

Jun. 17, 2011 (AU) ..... 2011902370

(51) Int. Cl.

| | |
|---|---|
| ***A45D 2/40*** | (2006.01) |
| ***A45D 1/04*** | (2006.01) |
| ***A45D 2/00*** | (2006.01) |

(52) U.S. Cl.

CPC .. *A45D 2/40* (2013.01); *A45D 1/04* (2013.01); *A45D 2/001* (2013.01)

USPC ..... 132/224

(58) Field of Classification Search

CPC ..... A45D 1/00; A45D 1/04; A45D 1/06; A45D 1/08; A45D 1/12; A45D 1/14; A45D 1/28; A45D 2/00; A45D 2/001

USPC ..... 132/223–225, 227–232; 219/227–229

See application file for complete search history.

(56) References Cited

U.S. PATENT DOCUMENTS

| | | | | |
|---|---|---|---|---|
| 2,103,676 | A * | 12/1937 | Karasiewicz | 132/225 |
| 4,032,747 | A * | 6/1977 | Kunz | 219/222 |
| 2011/0259356 | A1 * | 10/2011 | Barton et al. | 132/227 |

* cited by examiner

*Primary Examiner* — Rachel Steitz
(74) *Attorney, Agent, or Firm* — Tope-McKay & Associates

(57) ABSTRACT

Described is a hair iron comprising first and second side members pivotally connected at adjacent first ends thereof. A first heating plate is provided on a first surface of the first side member, and a second heating plate is provided on a first surface of the second side member such that moving the first and second side members to a closed position engages a section of hair between the first and second heating plates. Second ends of the first and second side members are tapered to aid separating the section of hair by sliding the hair iron longitudinally into the hair. Opposed first and second longitudinal edges of the first surfaces of the first and second side members are each curved such that the first longitudinal edges are concave in shape.

13 Claims, 5 Drawing Sheets

SECTION A-A

SECTION A-A

SECTION B-B

SECTION C-C

DETAIL A

HAIR IRON

BACKGROUND OF THE INVENTION (1) Field of Invention

The present invention relates to a hair iron and, more particularly, to hair iron having a design which makes the process of separating and treating sections of the hair easier.

(2) Description of Related Art

Many people wish to treat their hair to either create increased volume or to straighten the hair. For people with relatively fine hair that sits flat against the head, it may be desired to treat the hair to lift the hair away from the head and create the appearance of a fuller head of hair. Crimping irons can be used to add small waves to portions of the hair near the scalp to make the hair stand away from the head and provide increased volume. Crimping irons generally comprise a pair of heated plates that can be pivoted together around sections of hair.

Hair straightening irons for straightening wavy or curly hair comprise a similar construction. That is, a pair of heated plates that can be engaged around sections of hair to heat the hair and straighten it. In the case of straightening irons, the heated plates include a flat surface.

Thus, a continuing need exists for an improved hair iron that makes the process of separating and treating sections of the hair easier.

SUMMARY OF THE INVENTION

The present invention relates to a hair iron and, more particularly, to hair iron having a design which makes the process of separating and treating sections of the hair easier. The hair iron comprises first and second side members pivotally connected at adjacent first ends thereof; a first heating plate provided on a first surface of the first side member; and a second heating plate provided on a first surface of the second side member, such that moving the first and second side members to a closed position engages a section of hair between the first and second heating plates. Second ends of the first and second side members are tapered to aid separating the section of hair by sliding the hair iron longitudinally into the hair, wherein opposed first and second longitudinal edges of the first surfaces of the first and second side members are each curved such that the first longitudinal edges are concave in shape.

In another aspect, the curves in the first and second longitudinal edges extend from a location between the first and second ends of the first and second arm members to the second ends thereof.

In another aspect, the first and second longitudinal edges of the first and second arm members are parallel to each other from the first ends thereof to a location between the first and second ends thereof, wherein the curve of the second longitudinal edge is greater than that of the first longitudinal edge from said location between the first and second ends to the second end, such that the first and second longitudinal edges approach each other to form a tapered end portion adjacent the second end.

In another aspect, the first and second side members each include a second side surface which is arcuate in transverse cross section such that each second side surface extends from the first longitudinal edge of the first side surface to the second longitudinal edge of the first side surface.

In another aspect, the second side surfaces of the first and second side members decrease in height above the respective first side surfaces towards the second end.

In another aspect, the arcuate shape of the longitudinal cross section of the second side surfaces decrease in size towards the second end such that the tapered end portion decreases in cross sectional size towards the second end.

In another aspect, each of the heating plates extends along a portion of the length of the respective side member from a location adjacent the second end to a location between the second end and the first end.

In another aspect, a heat control is provided to control the heat applied to the first and second heating plates.

In another aspect, the heat control comprises a dial located on the first side surface of the second side member such that a portion of the periphery thereof extends outwardly beyond the first longitudinal edges of the first and second side members.

In another aspect, the hair iron further comprises a plurality of longitudinal corrugations provided on the first heating plate; and a plurality of longitudinal corrugations provided on the second heating plate being complementary in shape to the corrugations on the first heating plate, such that the first and second side members can be pivoted between a closed position in which the corrugations on the first heating plate engage with the corrugations on the second heating plate and an open position in which the first and second heating plates are separated to receive hair. Moving the first and second side members to the closed position engages the section of hair between the first and second heating plates and crimps the hair adjacent the scalp to create volume.

In another aspect, the corrugations provided on the heating plates decrease in amplitude moving in a direction away from a first longitudinal edge towards a second longitudinal edge.

In another aspect, the corrugations define a generally square waveform decreasing in amplitude from the first longitudinal edge towards the second longitudinal edge.

In another aspect, upper surfaces of the first and second heating plates are flat to provide for straightening of hair engaged between the heating plates.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
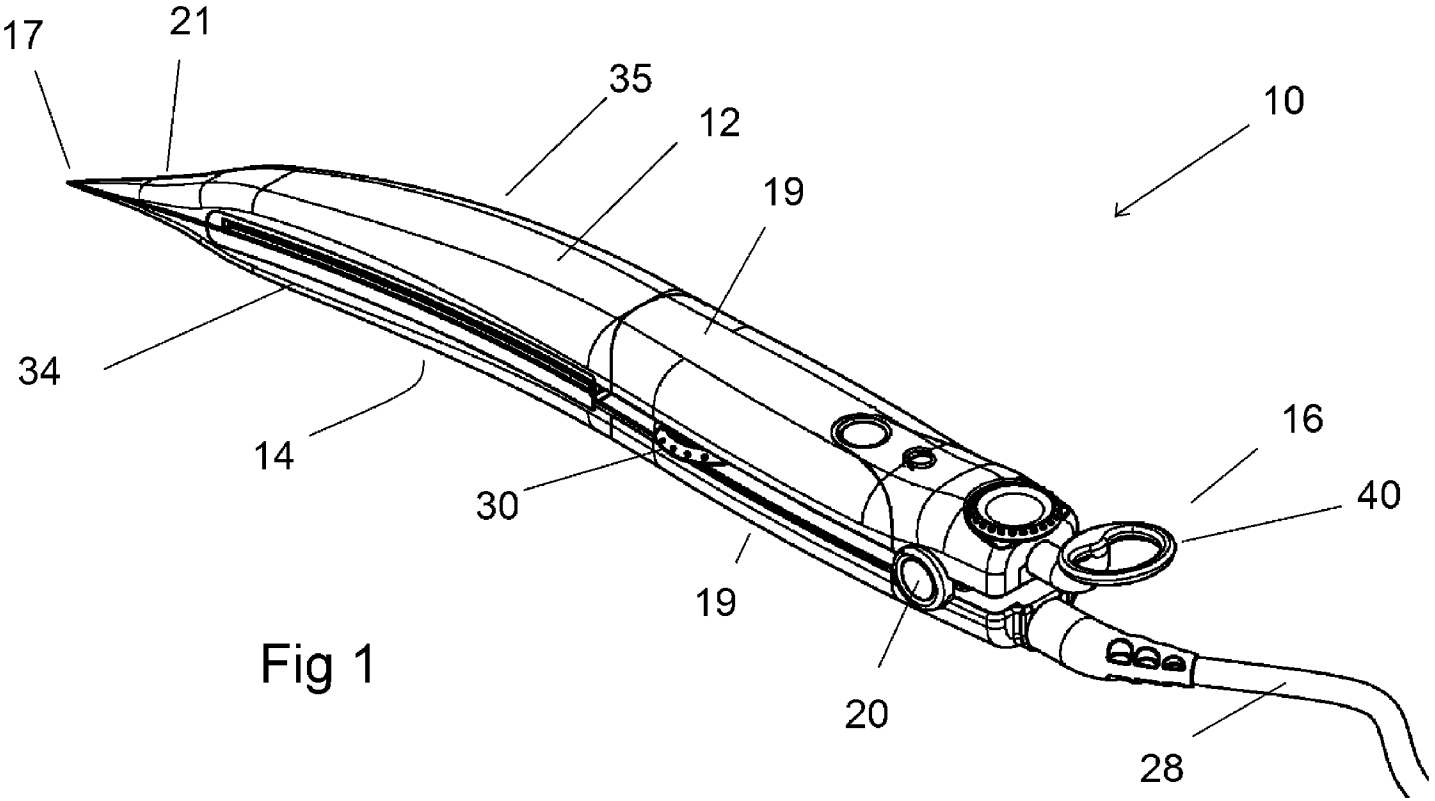
FIG. 1 is a top, perspective-view illustration of a hair iron in accordance with the present invention.

The present invention relates to a hair iron and, more particularly, to a hair iron having a design which makes the process of separating and treating sections of the hair easier. The following description is presented to enable one of ordinary skill in the art to make and use the invention and to incorporate it in the context of particular applications. Various modifications, as well as a variety of uses, in different applications will be readily apparent to those skilled in the art, and the general principles defined herein may be applied to a wide range of embodiments. Thus, the present invention is not intended to be limited to the embodiments presented, but is to be accorded with the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter-clockwise have been used for convenience purposes only and are not intended to imply any particular fixed direction. Instead, they are used to reflect relative locations and/or directions between various portions of an object. As such, as the present invention is changed, the above labels may change their orientation.

(1) Specific Details

Referring to FIGS. 1-5*c*, there is shown a hair iron 10 comprising generally a first side member 12 and a second side member 14. Each of the first and second side members 12 and 14 comprises an elongate member having a first end 16 and a second end 17.

The first and second side members 12 and 14 are pivotally connected to each other adjacent the first ends 16. Each of the first and second side members 12 and 14 includes a first side surface 18. The first side surfaces 18 are generally planar, and the first side surface 18 of the first side member 12 is adjacent the first side surface 18 of the second side member 14.

Figure 2A:
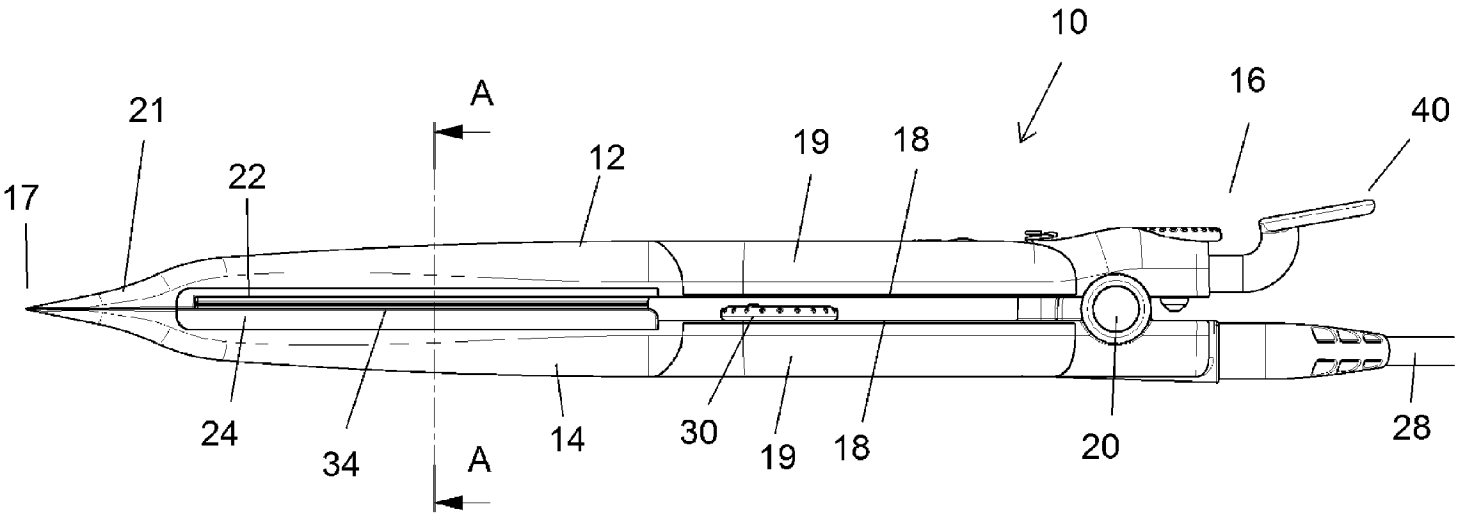
FIG. 2*a* is a side-view illustration of the hair iron of FIG. 1 in accordance with the present invention.
Figure 2B:
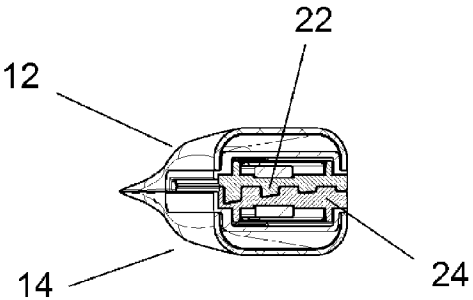
FIG. 2*b* is a cross-sectional-view illustration of the hair iron of FIG. 2*a* through the line A-A in accordance with the present invention.

The pivotal connection between the first and second side members 12 and 14 is provided by a hinge mechanism 20 located adjacent the first ends 16 of the first and second side members 12 and 14. The first and second side members 12 and 14 are pivotable between a closed position (as shown in FIG. 2), in which the first side surface 18 of the first side member 12 is adjacent and parallel to the first side surface 18 of the second side member 14, and an open configuration in which the first and second side members 12 and 14 are moved away from each other.

The hinge mechanism 20 is located offset slightly from the first ends 16 of the first and second side members 12. The first and second side members 12 and 14 can, therefore, be pivoted to the open position by pressing together the first and second side members 12 and 14 between the hinge mechanism 20 and the first end 16.

The first end 16 of the first side member 12 is provided with a hook 40 for hanging the heating iron 10. The hook 40 comprises a shaft extending outwardly from the first end 16 of the first side member 12 having a ring on a distal end thereof.

In the embodiment shown, each of the first and second side members 12 and 14 includes a second side surface 19, being opposite the first side surface 18. The second side surfaces 19 are arcuate in transverse cross section such that each second side surface 19 extends from a first longitudinal edge 34 of the first side surface 18 to an opposite second longitudinal edge 35 of the first side surface 18.

The first side member 12 is provided with a first heating plate 22 secured to the first side surface 18 thereof. The second side member 14 is provided with a second heating plate 24 secured to the first side surface 18 thereof. Each of the first and second heating plates 22 and 24 includes a lower surface that is secured to the first side surface 18 of the corresponding side member 12 or 14, and an upper surface 21 that is located remote from the lower surface. The upper surface 21 of the first heating plate 22 is, therefore, arranged adjacent the upper surface 21 of the second heating plate 24 such that the upper surfaces 21 engage when the first and second side members 12 and 14 move to the closed configuration.

Each of the heating plates 22 and 24 extends along a portion of the length of the associated side member 12 or 14 from a location adjacent the second end 17 to a location adjacent a midpoint of the side member 12 or 14.

In the embodiment shown, the heating iron 10 is constructed as a crimping iron in order to add volume to the hair. The upper surfaces 21 of the first and second heating plates 22 and 24 include longitudinal corrugations 26 along the length thereof. It will be appreciated, though, that in the case of the heating iron 10 being used for straightening the hair, the upper surfaces 21 of the heating plates 22 and 24 would be flat.

Figure 4A:
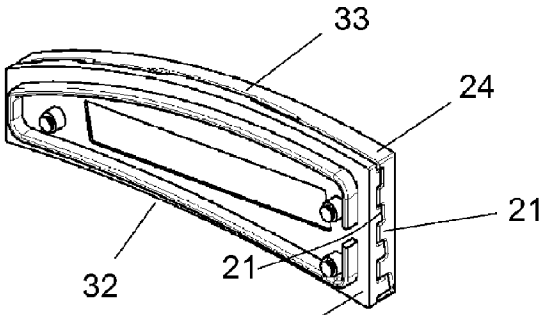
FIG. 4*a* is an upper, perspective-view illustration of the heating plates of the hair iron of FIG. 1 in accordance with the present invention.
Figure 4B:
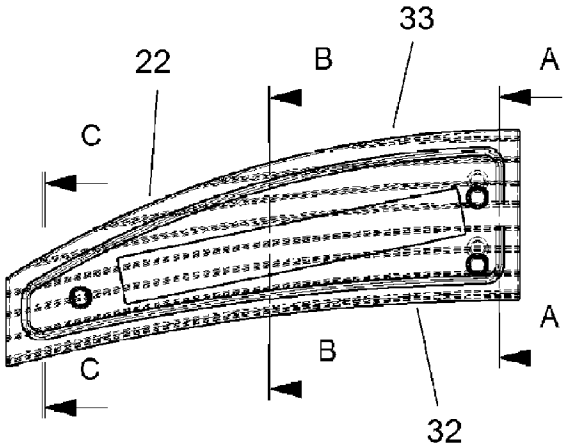
FIG. 4*b* is a top-view illustration of the heating plates with the shape of the corrugations shown in broken lines in accordance with the present invention.
Figure 4C:
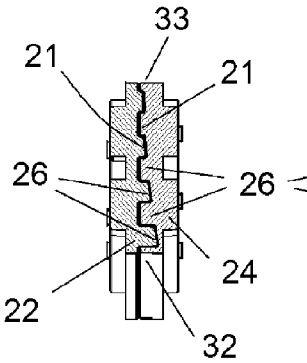
FIG. 4*c* is a cross-sectional-view illustration of the heating plates of FIG. 4*b* through the line A-A in accordance with the present invention.
Figure 4D:
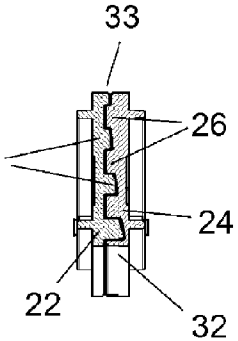
FIG. 4*d* is a cross-sectional-view illustration of the heating plates of FIG. 4*b* through the line B-B in accordance with the present invention.
Figure 4E:
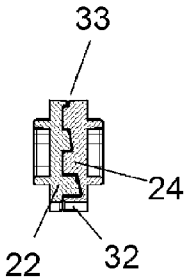
FIG. 4*e* is a cross-sectional-view illustration of the heating plates of FIG. 4*b* through the line C-C in accordance with the present invention.
Figure 5B:
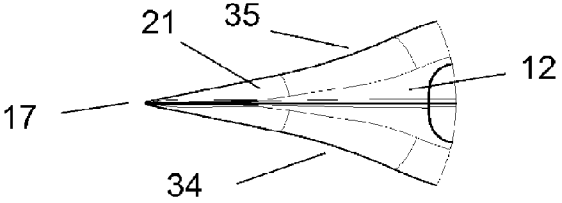
FIG. 5*b* is an enlarged view illustration of Detail A of FIG. 5*a* in accordance with the present invention.
Figure 5A:
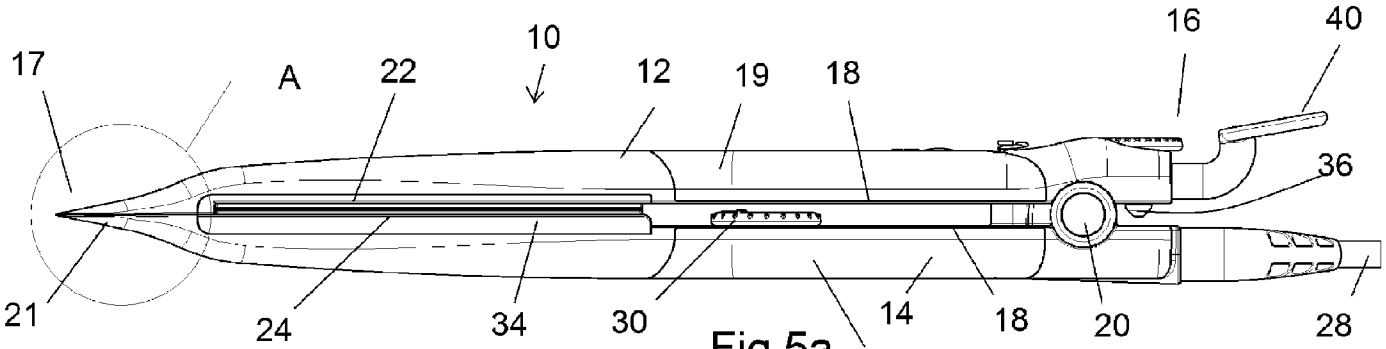
FIG. 5*a* is a side-view illustration of the hair iron of FIG. 1 in accordance with the present invention.
Figure 5C:
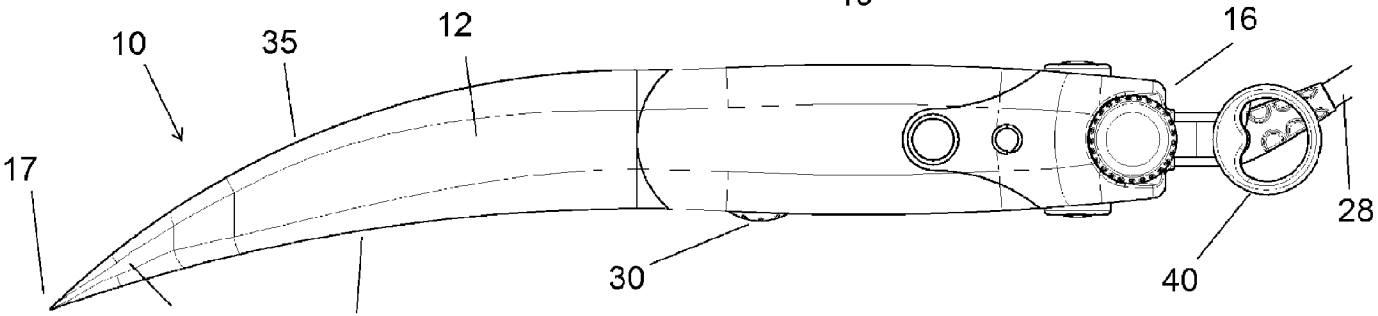
FIG. 5*c* is a top-view illustration of the hair iron of FIG. 1 in accordance with the present invention.

The corrugations 26 in the upper surfaces 21 comprise a plurality of ribs extending parallel to longitudinal axes of the side members 12 and 14. The corrugations 26 in the first heating plate 22 are complementary to the corrugations 26 of the second heating plate 24. That is, when the first heating plate 22 engages with the second heating plate 24 (as best seen in FIGS. 4*c* to 4*e*), the ribs of the first heating plate 22 are received between adjacent pairs of ribs on the second heating plate 24.

The hair iron 10 is provided also with a heating element on each of the first and second side members 12 and 14. The heating elements are provided to apply heat to the heating plates 12 and 14. The heating elements comprise electrical heating elements, and a power cord 28 is provided extending from the first end of the second member 14 to supply power to the heating elements.

Figure 3A:
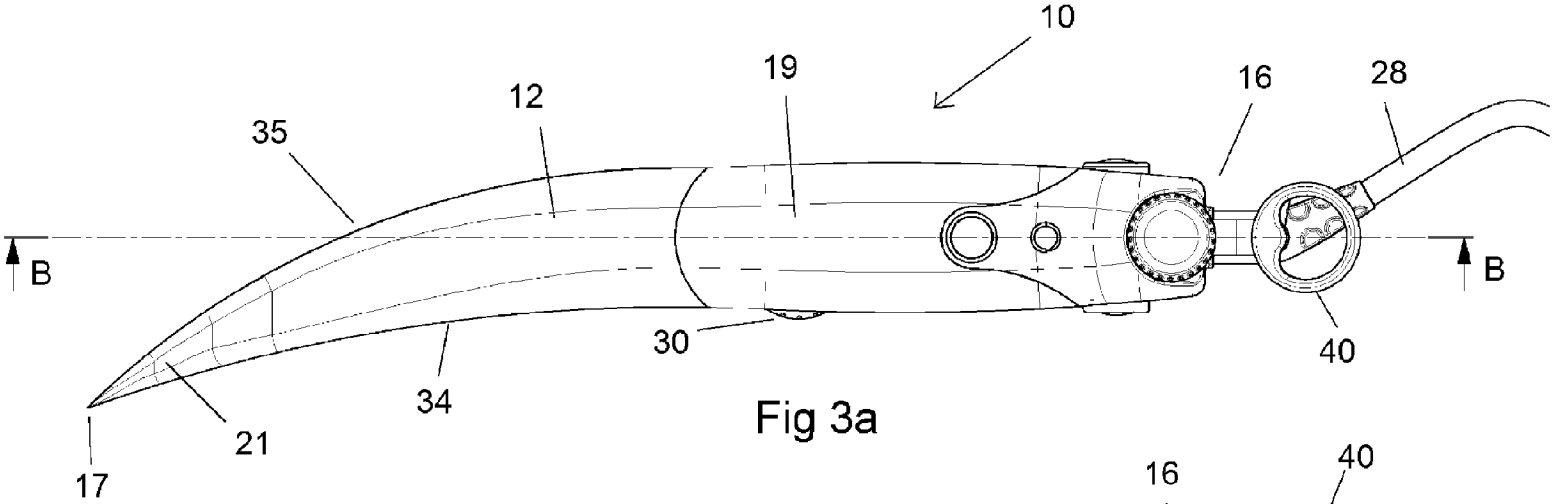
FIG. 3*a* is a top-view illustration of the hair iron of FIG. 1 in accordance with the present invention.
Figure 3B:
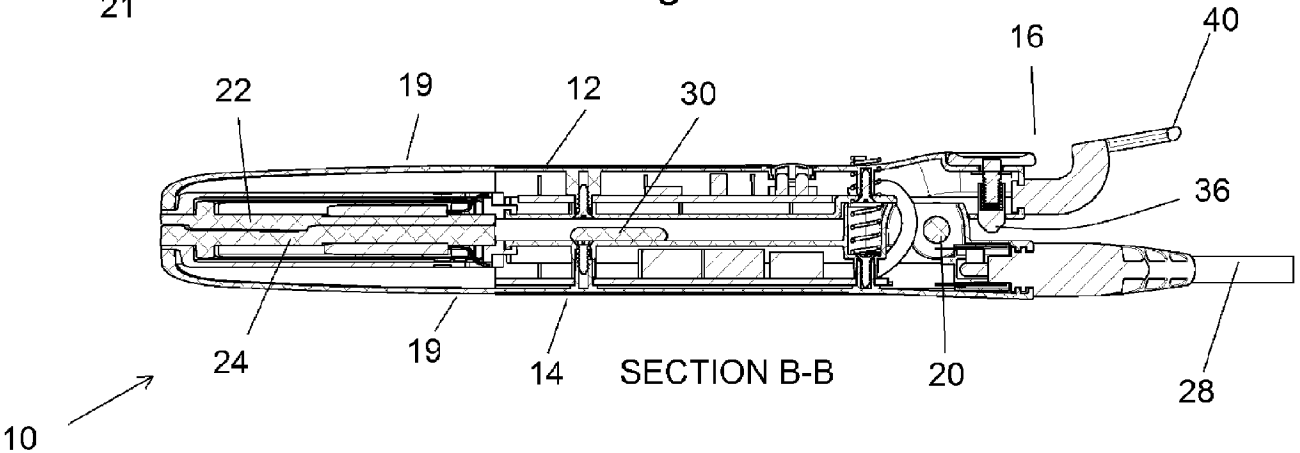
FIG. 3*b* is a cross-sectional-view illustration of the hair iron of FIG. 3*a* through the line B-B in accordance with the present invention.

A heat control may also be provided to control the operation of the heating elements and, thereby, the temperature of the heating plates 22 and 24. The heat control in the embodiment shown comprises a dial 30 located on the first side surface 18 of the second side member 14 between the second heating plate 24 and the hinge mechanism 20. The dial 30 is located such that a portion of the periphery thereof extends outwardly beyond the first longitudinal edges 34 of the first and second side members 12 and 14, as best seen in FIG. 3*a*. The dial 30 can, therefore, be operated while the first and second side members 12 and 14 are in the closed position by turning the dial 30 via the extending portion thereof.

The corrugations 26 are provided on the heating plates 24 such that the amplitude thereof decreases moving in a direction moving away from a first longitudinal edge 32 towards a second longitudinal edge 33. That is, the height of the ribs (and therefore the depth of the grooves between the ribs) decreases towards the second longitudinal edge 33. The first longitudinal edge 32 of the heating plates 22 and 24 is the edge oriented closest to the scalp in use.

The ribs in the embodiment shown are generally square in shape. That is, the corrugations define a generally square waveform decreasing in amplitude from the first longitudinal edge 32 towards the second longitudinal edge 33.

The first and second longitudinal edges of the heating plates 22 and 24 and the first and second longitudinal edges 34 and 35 of the first and second side members 12 are each curved. The first and second side members 12 and 14 are curved such that the first longitudinal edge 34 is concave in shape to conform generally to the curvature of the head. The second longitudinal edge 35 of the first and second side members 12 and 14 is curved to generally follow the curve of the first longitudinal edge 34.

In the embodiment shown, the curves in the first and second longitudinal edges 34 and 35 extend from a location between the first and second ends 16 and 17 of the first and second arm members 12 and 14 to the second ends 17 thereof.

From the first ends 16 of the first and second arm members 12 and 14 to a location between the first and second ends 16 and 17 thereof, the first and second longitudinal edges 34 and 35 are parallel to each other. From said location between the first and second ends 16 and 17, the curve of the second longitudinal edge 35 is greater than that of the first longitudinal edge 34 such that the first and second longitudinal edges 34 and 35 approach each other to form a tapered end portion 21 adjacent the second end 17.

Also, the second side surfaces 19 of the first and second side members 12 and 14 decrease in height above the respective first surfaces 18. That is, the arcuate shape of the longitudinal cross section of the second side surfaces 19 decrease in size along a portion adjacent the second end 17 such that the tapered end portion 21 decreases in cross sectional size towards the second end. That is, the tapered end portion 21 tapers down to a point.

The first and second side members 12 and 14 are also provided with an adjustment mechanism to limit the amount by which the first and second side members 12 and 14 move apart. In the embodiment shown, the adjustment mechanism comprises a peg 36 provided through an aperture in the first side member 12 between the hinge mechanism 20 and the first end 16.

An inner end of the peg 36 extends into a space between the first ends 16 of the first and second side members 12 and 14 such that when the side members 12 and 14 are pivoted towards the open position, the first end 16 of the second member 14 engages with the inner end of the peg 36. The peg 36 includes a threaded outer surface to engage with an internal thread in the aperture such that rotating the peg 36 causes an inner end to move towards or away from the second side member 14 to adjust the amount of movement of the side members 12 and 14 before the engagement with the peg 36.

In use, the hair iron 10 is used to treat sections of the hair for straightening or crimping. The first and second side members 12 and 14 are moved to the open configuration and oriented such that the first longitudinal edge 34 is adjacent and generally parallel to the scalp. The tapered end portions 21 of the first and second side members 12 and 14 are inserted into the hair, and the hair iron 10 is then moved longitudinally such that a section of hair is received between the first and second side members 12 and 14. The tapered end portions 21 provide easier separation of a section of hair for treatment.

The hair iron 10 is moved so that a section of hair is received between the first and second side members 12 and 14 with the hair passing generally transversely between the first and second side members 12 and 14 with the hair iron adjacent the scalp. By moving the first and second side members 12 and 14 to the closed position, the portion of the section of hair between the first and second side members 12 and 14 is clamped between the first and second heating plates 22 and 24.

In the case of heating plates 22 and 24 with corrugations 16, the corrugations 26 crimp the portion of the hairs and this crimp is set into the hair by the applied heat. As the corrugations decrease in size towards the second longitudinal edge 33, the size of the crimp in the hair decreases in a direction away from the scalp. Preferably the first rib on the first heating plate (and consequently the corresponding groove on the second heating plate) is located relatively close to the first longitudinal edge 32 such that the first crimp is placed close to the scalp.

The arrangement of the first and second side members 12 and 14 of the hair iron 10 and the heating plates 22 and 24 allows ease of use for separating sections of the hair and crimps the hair only adjacent the scalp, so the remainder of the hair appears straight. The decreasing of the crimp size away from the scalp provides a useful volumizing effect and square wave type crimp is believed to add a significant amount of volume over a relatively short section of hair.

In the case of use as a straightening iron, the heating iron 10 can engage sections of the hair from closely adjacent the scalp and then be moved outwardly to straighten the hair between the heating plates 22 and 24.

It will be readily apparent to persons skilled in the relevant arts that various modifications and improvements may be made to the foregoing embodiments, in addition to those already described, without departing from the basic inventive concepts of the present invention.

What is claimed is:

1. A hair iron comprising:

first and second side members pivotally connected at adjacent first ends thereof;

a first heating plate provided on a first surface of the first side member; and a second heating plate provided on a first surface of the second side member such that moving the first and second side members to a closed position engages a section of hair between the first and second heating plates;

wherein second ends of the first and second side members are tapered to aid separating the section of hair by sliding the hair iron longitudinally into the hair, and wherein opposed first and second longitudinal edges of the first surfaces of the first and second side members are each curved such that the first longitudinal edges are concave in shape.

2. The hair iron in accordance with claim 1, wherein the curves in the first and second longitudinal edges extend from a location between the first and second ends of the first and second arm members to the second ends thereof.

3. The hair iron in accordance with claim 2, wherein the first and second longitudinal edges of the first and second arm members are parallel to each other from the first ends thereof to a location between the first and second ends thereof, and wherein the curve of the second longitudinal edge is greater than that of the first longitudinal edge from said location between the first and second ends to the second end, such that the first and second longitudinal edges approach each other to form a tapered end portion adjacent the second end.

4. The hair iron in accordance with claim 3, wherein the first and second side members each include a second side surface which is arcuate in transverse cross section such that each second side surface extends from the first longitudinal edge of the first side surface to the second longitudinal edge of the first side surface.

5. The hair iron in accordance with claim 4, wherein the second side surfaces of the first and second side members decrease in height above the respective first side surfaces towards the second end.

6. The hair iron in accordance with claim 5, wherein the arcuate shape of the longitudinal cross section of the second side surfaces decrease in size towards the second end such that the tapered end portion decreases in cross sectional size towards the second end.

7. The hair iron in accordance with claim 6, wherein each of the heating plates extends along a portion of the length of the respective side member from a location adjacent the second end to a location between the second end and the first end.

8. The hair iron in accordance with claim 7, wherein a heat control is provided to control the heat applied to the first and second beating plates.

9. The hair iron in accordance with claim 8, wherein the heat control comprises a dial located on the first side surface of the second side member such that a portion of the periphery thereof extends outwardly beyond the first longitudinal edges of the first and second side members.

10. The hair iron in accordance with claim 9, further comprising:

a plurality of longitudinal corrugations provided on the first heating plate; and a plurality of longitudinal corrugations provided on the second beating plate being complementary in shape to the corrugations on the first heating plate, such that the first and second side members can be pivoted between a closed position in which the corrugations on the first heating plate engage with the corrugations on the second heating plate and an open position in which the first and second heating plates are separated to receive hair;

wherein moving the first and second side members to the closed position engages the section of hair between the first and second heating plates and crimps the hair adjacent the scalp to create volume.

11. The hair iron in accordance with claim 10, wherein the corrugations provided on the heating plates decrease in amplitude moving in a direction away from the first longitudinal edge towards the second longitudinal edge.

12. The hair iron in accordance with claim 11, wherein the corrugations define a generally square waveform decreasing in amplitude from the first longitudinal edge towards the second longitudinal edge.

13. The hair iron in accordance with claim 1, wherein upper surfaces of the first and second heating plates are flat to provide for straightening of hair engaged between the heating plates.

* * * * *